US007847170B1

(12) United States Patent
Anderson et al.

(10) Patent No.: US 7,847,170 B1
(45) Date of Patent: Dec. 7, 2010

(54) ANCHOR FOR MUSICAL INSTRUMENT STRINGS

(76) Inventors: Richard Anderson, 1218 N. 35th St., Renton, WA (US) 98056; Dean Wattles, 403-17th St. NW, Puyallup, WA (US) 98371

( * ) Notice: Subject to any disclaimer, the term of this patent is extended or adjusted under 35 U.S.C. 154(b) by 20 days.

(21) Appl. No.: 12/412,860

(22) Filed: Mar. 27, 2009

(51) Int. Cl.
*G10D 3/04* (2006.01)

(52) U.S. Cl. ..... 84/298

(58) Field of Classification Search ..... 84/298, 84/297 R, 290, 297 S, 304, 313, 327, 329; D17/20
See application file for complete search history.

(56) References Cited

U.S. PATENT DOCUMENTS 4,829,871 A 5/1989 Manson
5,140,884 A 8/1992 Bowden
5,260,504 A 11/1993 Turner
7,154,032 B2 * 12/2006 Burchfield ..... 84/304

* cited by examiner

*Primary Examiner*—Jianchun Qin
(74) *Attorney, Agent, or Firm*—David L. Tingey

(57) ABSTRACT

A string anchor useful for anchoring a guitar string to a guitar bridge. The string anchor body has a body slot extending along the body side to the through hole. The body is adapted to receive the string enlarged end into the through hole at an anchor body top and through the through hole downward to outside of the anchor body bottom such that as the string adjusted such that its enlarged end is alongside the body and is pulled upward through the through hole and the slot, the string enlarged end is pulled against the anchor body and the bridge plate.

20 Claims, 7 Drawing Sheets

ANCHOR FOR MUSICAL INSTRUMENT STRINGS

BACKGROUND

1. Field of the Invention

This invention relates primarily to an anchor for securing a guitar string to a guitar bridge, and more specifically to a string anchor insert for a guitar bridge.

2. Prior Art

Quality of sound from a guitar is enhanced through the construction of the guitar body, or guitar box, having an internal cavity in which acoustical waves resonate. Similar guitar strings mounted to different guitars will produce a different sound because of the construction of the guitar body. Different curvatures and woods employed in the body will produce different resonances. Primarily, acoustical vibrations are transferred from a vibrating string through the guitar sound hole. However, a significant contribution is obtained in the transfer of vibrations from the string directly to the guitar body through the mount of the string body end to the body through a guitar bridge that is permanently mounted rearward of the guitar sound hole in normal guitar construction. It is therefore important that the string engage the bridge in all methods of securing the strings to the bridge.

It is common for a guitar string to break after a period of use. Conventional replacement requires a tapered bridge pin to be removed and the string to be extracted from the bridge through a bridge pin hole that receives the bridge pin. A guitar string characteristically has a first end that is enlarged by the string at that end wrapped around a ring. The string first end is then inserted into the bridge pin hole followed by the bridge pin with the string moved into a groove along the side of the bridge pin. The string is pulled tight and the pin is pressed into frictional engagement with the bridge top. The procedure might take about a couple of minutes.

Repeated removal and installation of the pin can damage the pin and more importantly will damage the bridge pin hole. When the guitar bridge hole is damaged, it must be repaired. Typically, this requires re-drilling the bridge pin hole to an enlarged size and replacing the pin with a larger pin. A better method would be to provide an anchor that does not require removal and reinstallation during string replacement and maintains the characteristic solid connection between the string and the guitar bridge to conduct string acoustical wave energy to the guitar bridge and hence to the guitar body.

SUMMARY OF THE INVENTION

An improved mounting of a guitar string to a guitar is obtained with the string anchor of the present invention. As stated, with repeated removal of a tapered pin from a bridge hole, the bridge hole suffers wear. As a result, the tapered pin begins to pop out of the bridge hole under pull from a tensioned string. The new string anchor of the present invention does not require removal to change a string associated with the anchor, which reduces wear to the guitar bridge and enables a faster change of a string. No part is removed as the string is easily released from the anchor simply by giving slack to the string and unhooking its enlarged end from the anchor and then pulling the unhooked string through a hole in the anchor, which has been installed in the guitar bridge.

For bridges that have suffered wear a normal repair typically requires about an hour or more to repair the bridge for continued use with a tapered pin. However, repair using the string anchor of the present invention requires only a quick re-drill of the bridge hole and inserting the anchor into the hole, a matter of only a few minutes for all six holes.

Connection to the bridge is by press fitting the anchor from the bottom of the bridge or otherwise attaching the anchor at the bridge bottom, such as by gluing. The bridge hole is typically, though not necessarily, right cylindrical. In further description of the anchor and its installation, installation of the anchor in a hole that is not orthogonal to the guitar box top is deemed to be included in the description of the orthogonal bridge hole.

The anchor comprises a body with an axial through hole therethrough with open top and bottom ends with a slot along a side that extends to the through hole the transverse cross section of the anchor forming a C-shape through the length of the anchor. To install a new string, the enlarged end of the string inserts through the through hole of the anchor to outside the anchor body bottom end. The string enlarged end is then manipulated to alongside the anchor and slot and then pulled upward along the body as the string passes through the slot to engagement with the bridge plate.

The invention is described in terms of a musical string attached to a musical instrument. It should be understood that the invention may be applied to other applications in which a string or cable or the like is attached between two positions. The described anchor is for attachment of one end of the string or cable to any location, which to represent the generality may be described herein as a fixture instead of a musical instrument.

BRIEF DESCRIPTION OF THE DRAWINGS

FIG. 13 is a cross sectional view of the string anchor installed as aligned in FIG. 11 with a string installed in the slot.

DETAILED DESCRIPTION OF THE PREFERRED EMBODIMENTS

Figure 1:
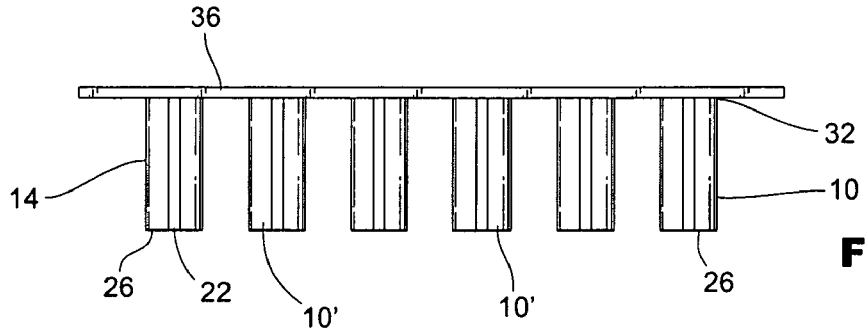
FIG. 1 is a side view of a plurality of string anchors held together in a string anchor plate.

The string anchor 10 of the present invention is for connecting a string 11 that has a string diameter and a string enlarged end 12 to a guitar bridge. For ease of description, all stringed musical instruments are deemed included in the following description of the invention with reference to a guitar 100 with a guitar bridge 102 into which the string anchor 10 mounts. Further, attachment of a string or cable generally, that is, not in a musical instrument, is deemed included in the description of a string installed to a guitar by use of the described anchor. Also, in describing the invention in terms of a bridge, the bridge is deemed to mean any structure in which a through hole is provided for receiving a string.

It is well known to have a guitar 100 with a guitar acoustical box 110, including a box top 114 and bottom (not shown) separated by box sides (not shown) and a bridge hole 120 through the bridge 102 for receiving a guitar string 11 with the bridge plate 104 and bridge top 106 sandwiching the box top 114 between them with the bridge plate 104 within the box 110. Guitar strings typically have a string diameter and the enlarged end, or enlargement 12 at a string first end 13 and are anchored at the string first end 13 to the guitar 100 at a first, or bridge, position 124 and secured to the guitar 100 under adjustable tension at a string second end 7 at a guitar second position 9 spaced apart from the first position 124.

The string anchor 10 comprises a cylindrical body 14 comprising a section of a hollow tube having a side wall 20 and an open top end 32 and an open bottom end 26, and an axial through hole between the open top end 32 and the open bottom end 26, and a body slot extending along the body side wall 20 the entire length of the body 14 between the open top end 32 and the open bottom end 26. The body 14 slot 22 thus extends along the body side wall 20 and through the cylindrical body 14 from the body side 20 to the through hole 16. The width of body slot 22 is larger than the string diameter and smaller than the string enlarged end 12 and the through hole 16 is larger than the string enlarged end 12. The anchor 10 is adapted to receive the string enlarged end 12 slidably into the through hole 16 at an open anchor body top 32 and through the through hole 16 and then downward through the through hole 16 to outside of the cylindrical body 14 at the anchor body bottom 26. As the string 16 is positioned in the slot 22 with the enlarged end 12 at the side of the body 14 the string 11 is pulled upward through the through hole 16, the string enlarged end 12 smaller than the body slot 22 is pulled against the anchor body 14 and up against the bridge plate 104 and is thus anchored to the string anchor 10.

The body slot 22 extends upward from the anchor bottom 26 to the anchor body top 32 along the body side wall 20 and through the cylindrical body 14 from the body side 20 to the through hole 16 to receive the string 11 passing through the body slot 22 such that as the string 11 pulled through the body slot 22 and upward through the through hole 16, the string enlarged end 12 being larger than the body slot 22 is pulled against the anchor body side wall 20 and is thus anchored to the string anchor 10. Around its circumference of the string anchor 10 intermediate the anchor body between the anchor top and the anchor bottom may be a ring 34 for effectively securing the string anchor to a bridge 102 (or fixture, generally).

For convenience in installing, a plurality of string anchors 10' may be held together in a string anchor plate 36 as a unitary assembly that is independent of a musical instrument bridge top with the string anchors 10' arranged spaced apart in a line adapted to be received in a plurality of bridge holes 120 in the guitar bridge 102, in which case the rings 34 of the respective bridges 10 combine into the string anchor plate 36. The string anchor plate 36 may be secured to the string anchors 10' intermediate their lengths with the anchor body portion above the string anchor plate 36 extending upward toward or into the bridge top 106 when installed. However, in the preferred embodiment the anchor plate 36 is installed at the respective anchor body tops 32 of the several anchors 10' with the anchor bodies 14 depending from the anchor plate 36 into the acoustical box 110. In preserving the appearance of the guitar, the anchors 10 are not visible from above the bridge top 106. The anchor plate 36 when installed in the bridge 122 is either sandwiched between the guitar box top 114 and the bridge top 106 or between the guitar box top 114 and the bridge plate 104. Preferably, the anchor plate is attached in a groove 132 in the bridge top 106 adapted to receive the anchor plate 36, such as by glue, with the anchor plate 36 fully enclosed between the bridge top 106 and the guitar box top 114 as the bridge top 106 is secured to the guitar box top 114. Thus, the anchor is adapted to mount to the guitar with the body bottom extending beyond the guitar hole and the body top not extending beyond the guitar hole.

Figure 2:
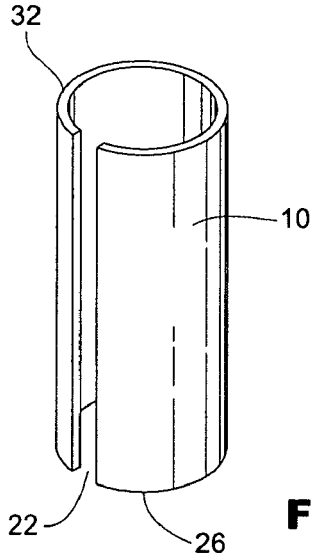
FIG. 2 is a perspective view of a string anchor showing a through hole and a slot along the anchor body side.
Figure 2A:
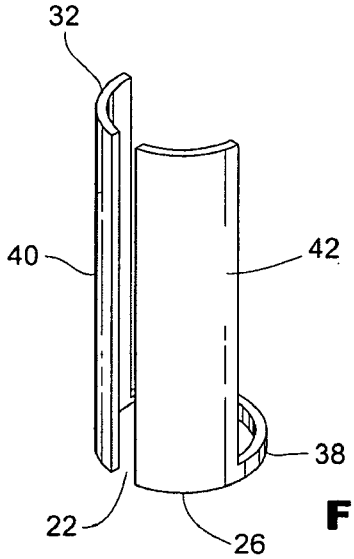
Figure 3:
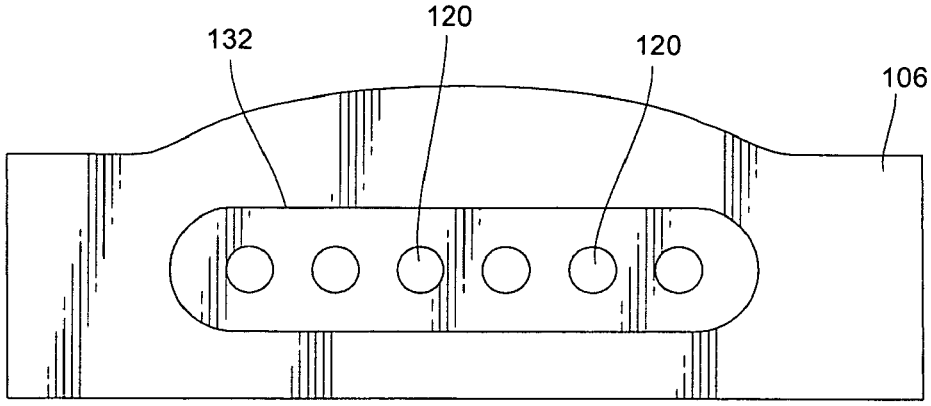
FIG. 3 is a bottom view a bridge top, grooved to receive the anchor plate of FIG. 1.
Figure 4:
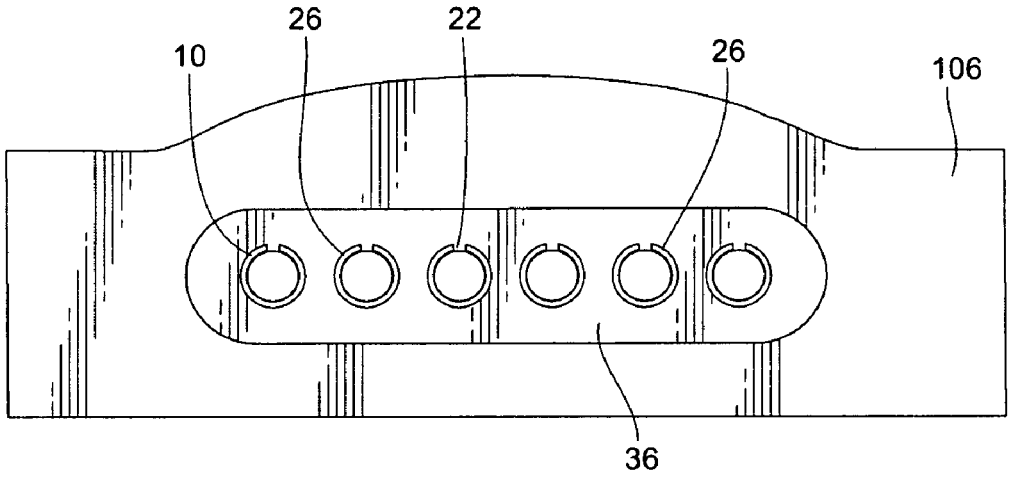
FIG. 4 is a bottom view of the bridge top of FIG. 3 shown with the plurality of string anchors and anchor plate of FIG. 1 with the anchor plate mounted within the groove shown in FIG. 3 on the underside of a bridge top with the string anchors extending outward from the underside of the bridge top.
Figure 5:
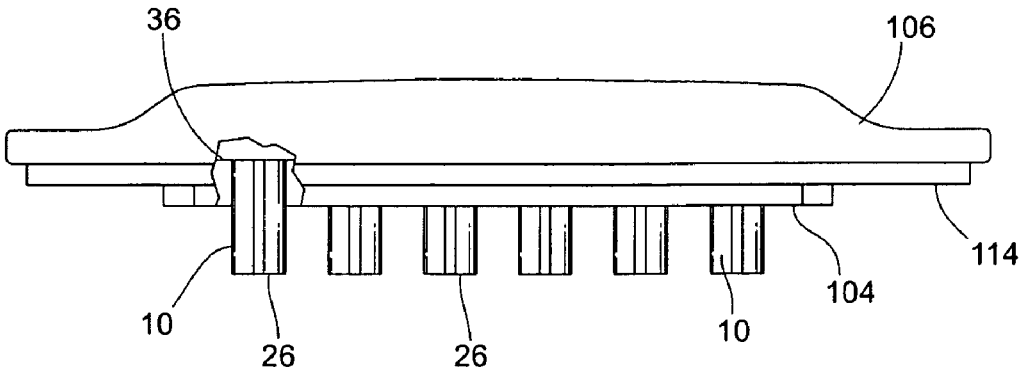
FIG. 5 is a side cut-away view showing the string anchors and string anchor plate of FIG. 1 installed between a bridge top and a bridge plate that sandwich a guitar top with the string anchors depending downward through the bridge plate.
Figure 6:
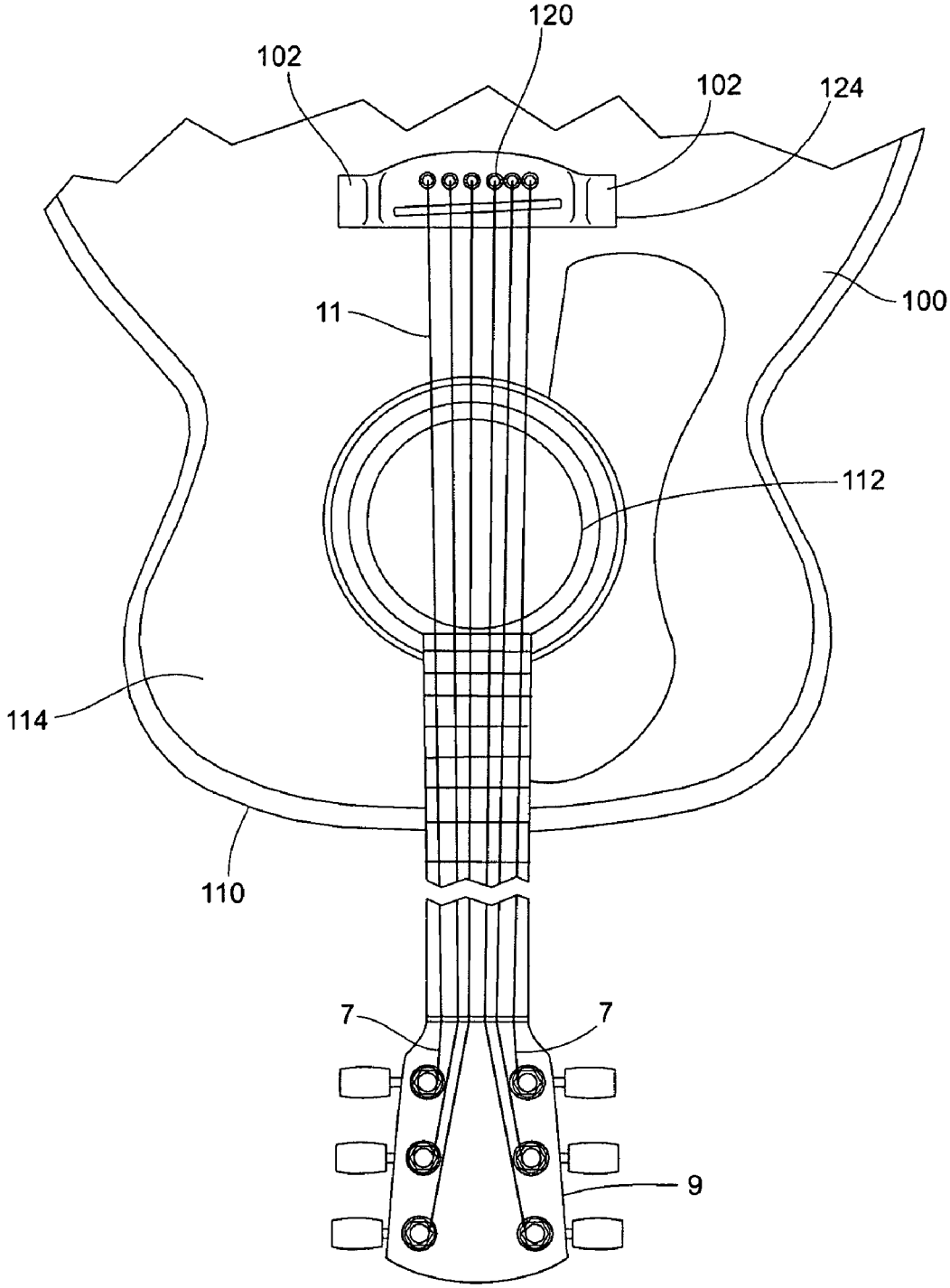
FIG. 6 is a top view of a portion of a guitar showing the string anchors and anchor plate of FIG. 1 mounted below the bridge top.
Figure 7:
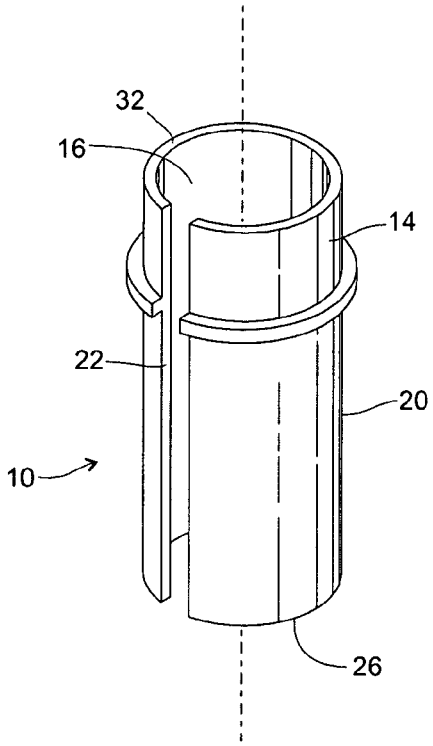
FIG. 7 is a perspective view of a string anchor in an alternative embodiment showing a ring round its circumference intermediate its length.
Figure 8:
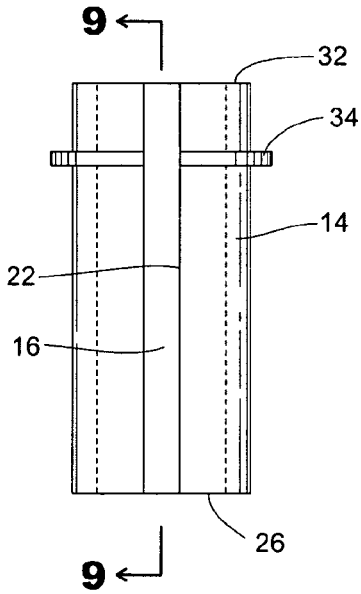
FIG. 8 is a side view of the string anchor of FIG. 7.
Figure 9:
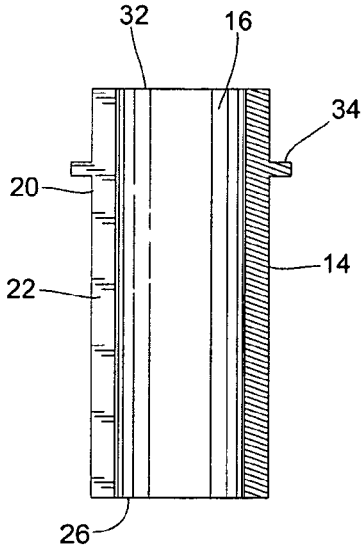
FIG. 9 is a side cross sectional view of the string anchor of FIG. 8.
Figure 10:
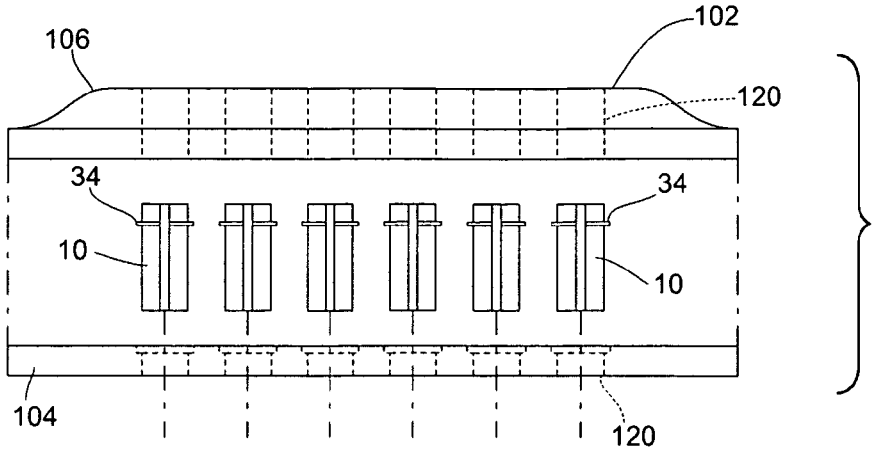
FIG. 10 is a side view of an assembly of a plurality of string anchors of FIG. 7, shown aligned for mounting between a guitar top and a bridge plate adapted such that the ring is received into the bridge plate.
Figure 11:
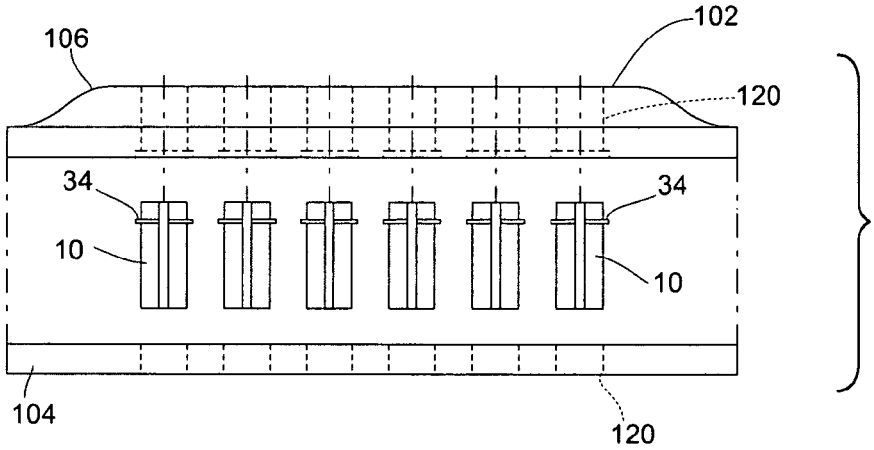
FIG. 11 is a side view of an assembly of a plurality of string anchors of FIG. 7, shown aligned for mounting between a guitar top and a guitar plate adapted such that the ring is received into the bridge top.
Figure 12:
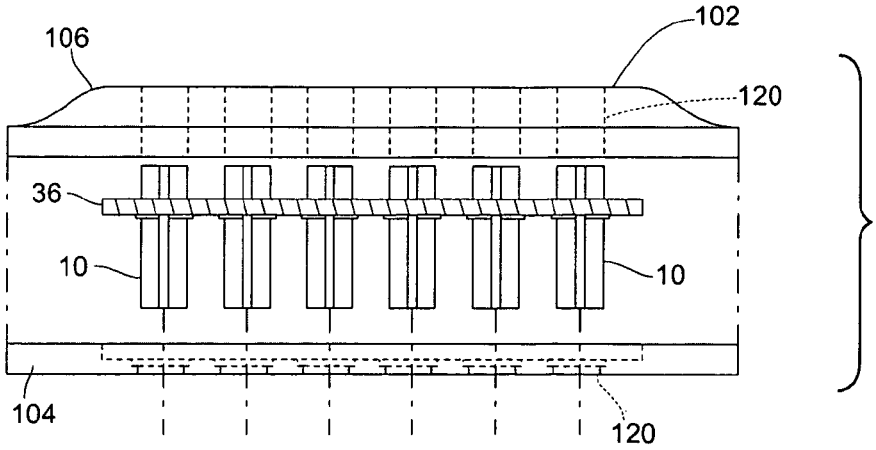
FIG. 12 is a side view of an assembly of a plurality of string anchors of FIG. 7 mounted in a string anchor plate for ease of installation, shown aligned for mounting between a guitar top and a guitar plate adapted such that the ring is received into the bridge plate.
Figure 13:
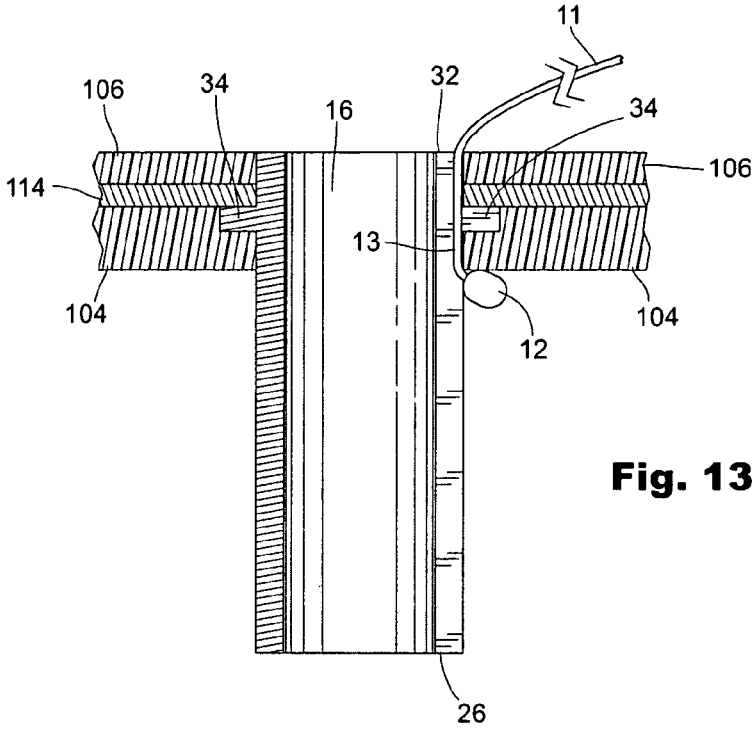
FIG. 13 is a cross sectional view of the string anchor installed as aligned in FIG. 10 with a string installed in the slot.
Figure 14:
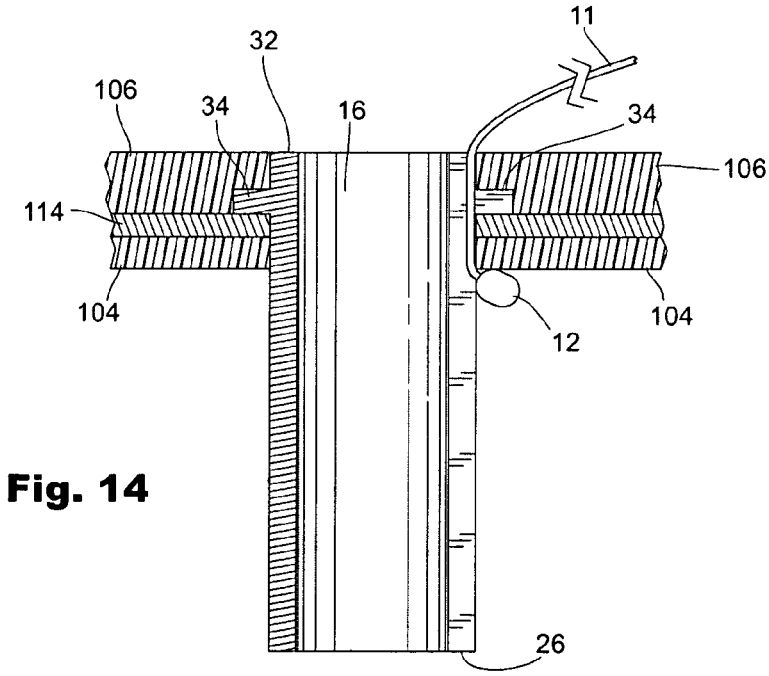
FIG. 14 is a cross sectional view of the string anchor installed as aligned in FIG. 12 with a string installed in the slot.
Figure 15:
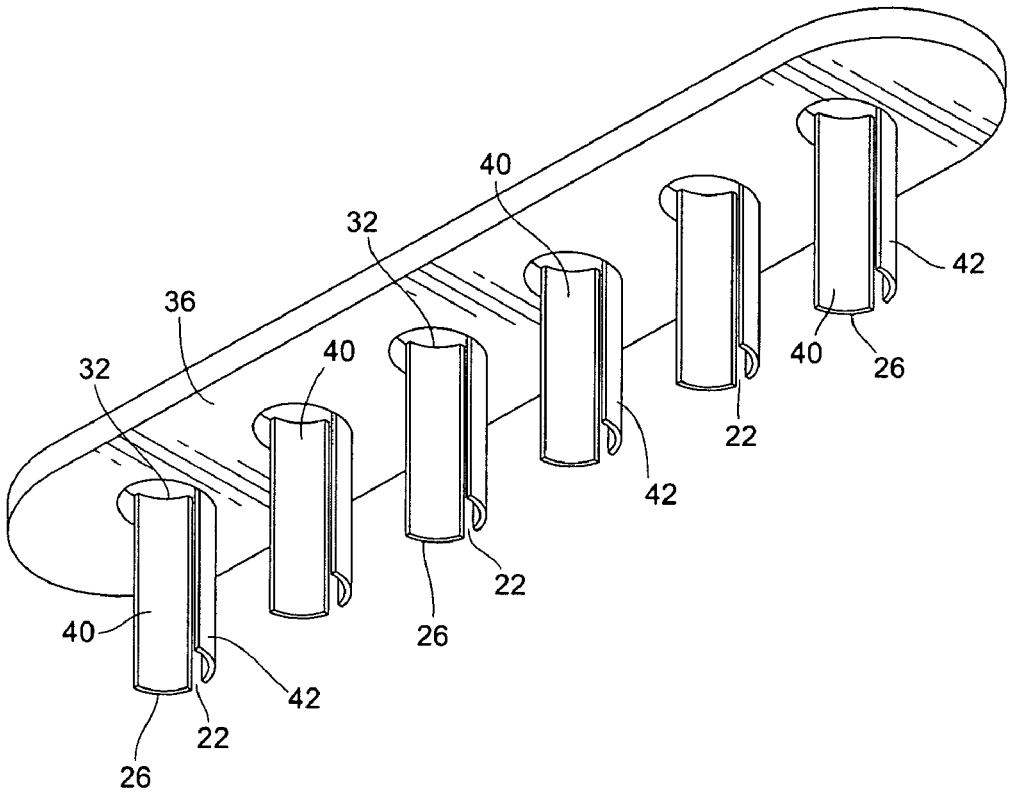
FIG. 15 is a bottom perspective view of a plurality of the string anchors of FIG. 2A mounted to an anchor plate without ring 38.

In an alternate embodiment shown in FIG. 2A, the string anchor 10 comprises a partial cylindrical body, typically a half cylindrical body with the slot 22 dividing the body into equal portions 40, 42. A ring 38 at the anchor bottom 26 holds the two portions together. When the string anchor 10 is installed as a plurality of anchors 10' held together from anchor plate 36 as described above, the ring 38 is not required and may be omitted as the two anchor portions 40, 42 are attached separately to the plate 36.

Having described the invention, what is claimed is as follows:

1. A cable anchor for anchoring a cable to a fixture having a fixture hole into which the cable anchor is secured, the cable having a cable diameter and having an enlarged end, the cable anchor comprising a body with a top and a bottom, said body comprising a section of a hollow tube having a side wall and an open top end and an open bottom end, and an axial through hole between the open top end and the open bottom end and a body slot extending along the body side wall the entire length of the side wall between the open top end and the open bottom end and through the body to the through hole, a width of the body slot being larger than the cable diameter and smaller than the enlarged end and the through hole being adapted to receive the cable enlarged end into the through hole and through the through hole to outside of the body which is adapted to mount to the fixture with the body bottom extending beyond the fixture hole and the body top not extending beyond the fixture hole with the through hole functionally aligned with the fixture hole such that the cable is adapted to pass through the opening at the body top end and into the body slot and out of the body slot at the body bottom end and the cable enlarged end can be manipulated to move along the slot outside the body such that when the cable is pulled upward through the through hole with the enlarged end alongside the body and not aligned with the through hole, the cable enlarged end is pulled against the anchor body and the fixture and is thus anchored to the cable anchor.

2. The string anchor of claim 1 wherein the body comprises a pair of separate body portions spaced apart by the body slot and connected by a joining member, the bore becoming an open volume only partially bounded by the body portions.

3. The string anchor of claim 1 further comprising a plurality of cable anchors depending from a cable anchor plate that is independent of a musical instrument bridge top forming a unitary cable anchor assembly such that the cable anchors on the cable anchor plate are mountable at once to the musical instrument.

4. The string anchor of claim 3 wherein the body of the string anchors comprises a pair of separate body portions spaced apart by the body slot, the bore becoming an open volume only partially bounded by the body portions.

5. A musical instrument with strings adapted to vibrate to produce musical tones, said strings each having a string diameter and an enlargement at its first end and each being anchored at said string first end to a musical instrument bridge at a musical instrument first position in a corresponding bridge hole, the improvement comprising a string anchor for each string the string anchor including a body with a top and a bottom, said body comprising a section of a hollow tube having a side wall and an open top end and an open bottom end, and an axial through hole between the open top end and the open bottom end and a body slot extending along the body side wall the entire length of side between the open top end and the open bottom end, each body further having a body slot extending along a body side, a width of the body slot being larger than the string diameter and smaller than the string enlargement, the string anchor adapted to receive the string enlargement into and through the through hole to outside of the body, the body being adapted to mount to the bridge with the through hole being in or functionally aligned with said corresponding bridge hole with the body bottom extending beyond the bridge hole and the body top not extending beyond the fixture hole such that the cable is adapted to pass into through the opening at the body top and the body slot and the cable enlargement can be manipulated to move along the slot outside the body and out of the body slot at the body bottom such that when the cable is pulled upward through the through hole with the enlargement alongside the body and not aligned with the through hole, the cable enlargement is pulled against the anchor body and the bridge and is thus anchored to the cable anchor.

6. The musical instrument of claim 5 in which the bridge comprises a bridge plate and a bridge top, the musical instrument comprises an acoustical box including a box top and bottom separated by box sides with the bridge plate and bridge top sandwiching the box top between them with the bridge plate within the box, said string anchor being mounted such that the anchor through hole opens into the musical box and the body slot extends into the musical box.

7. The musical instrument of claim 5 further comprising an anchor ring around the circumference of the string anchor intermediate the anchor body between the anchor top and the anchor bottom.

8. The musical instrument of claim 7 wherein the string anchor ring when installed in the bridge is sandwiched between the guitar box top and the bridge top.

9. The musical instrument of claim 7 wherein the string anchor ring when installed in the bridge is sandwiched between the guitar box top and the bridge bottom.

10. The string anchor of claim 5 wherein the body comprises a pair of separate body portions spaced apart by the body slot and connected by a joining member, the bore becoming an open volume only partially bounded by the body portions.

11. The musical instrument of claim 5 further comprising a plurality of string anchors on a string anchor plate forming a unitary string anchor assembly, the string anchors mounted in or functionally aligned with corresponding bridge holes, respectively.

12. The string anchor of claim 11 wherein the body of the string anchors comprises a pair of separate body portions spaced apart by the body slot, the bore becoming an open volume only partially bounded by the body portions.

13. The musical instrument of claim 11 wherein the string anchor plate when installed in the bridge is sandwiched between the guitar box top and the bridge top.

14. A string anchor for anchoring a string of a stringed musical instrument, said string having a string diameter and an enlargement at its first end and being adapted to be anchored at said string first end to a musical instrument bridge at a musical instrument first position in a corresponding bridge hole, the improvement comprising in the string anchor a body with a top and a bottom, said body comprising a section of a hollow tube having a side wall and an open top end and an open bottom end, and having a through hole therethrough and a body slot between the open top end and the open bottom end extending along the body side wall and through the body to the through hole, a width of the body slot being larger than the cable diameter and smaller than the enlargement and the string anchor being adapted to receive the cable enlargement into and through the through hole to outside of the body, the body being adapted to mount to the bridge with the through hole functionally aligned with said corresponding bridge hole with the body bottom extending beyond the bridge hole and the body top not extending beyond the fixture hole such that the string is adapted to pass through the opening at the body top and into the body slot and the string enlargement can be manipulated to move along the slot outside the body and out of the body slot at the body bottom such that when the string is pulled upward through the through hole with the enlargement alongside the body and not aligned with the through hole, the string enlargement is pulled against the anchor body and the bridge and is thus anchored to the string anchor.

15. The string anchor of claim 14 wherein the body comprises a pair of separate body portions spaced apart by the body slot and connected by a joining member, the bore becoming an open volume only partially bounded by the body portions.

16. The string anchor of claim 14 further comprising a plurality of said string anchors on a string anchor plate forming a unitary cable anchor assembly.

17. The string anchor of claim 14 wherein for a musical instrument having a bridge and the bridge hole in the bridge, the musical instrument comprising an acoustical box including a box top and bottom separated by box sides with a bridge plate below the box top and a bridge top above the box top sandwiching the box top therebetween with the bridge plate within the box, a further improvement comprising said string anchor being mountable at the bridge top and in or substantially in or aligned with said bridge hole in the bridge with the anchor body extending into the box and the anchor through hole opening into the box.

18. The string anchor of claim 14 further comprising a plurality of said string anchors on a string anchor plate forming a unitary cable anchor assembly adapted to mount to the bridge with through holes of each of the string anchors in functional alignment with corresponding bridge holes.

19. The string anchor of claim 18 wherein the body of the string anchors comprises a pair of separate body portions spaced apart by the body slot, the bore becoming an open volume only partially bounded by the body portions.

20. The string anchor of claim 18 wherein for a bridge top with a groove adapted to receive the string anchor plate, the string anchor plate is mountable within the groove, sandwiched between the box top and the bridge top outside the box.

* * * * *